US011433270B2

(12) United States Patent
Boatner et al.

(10) Patent No.: US 11,433,270 B2
(45) Date of Patent: Sep. 6, 2022

(54) KETTLE BELL AND METHODS OF USE THEREOF

(71) Applicants: Brian Boatner, Pontotoc, MS (US); Blake T. Hudson, Smyrna, GA (US); Hamilton G. Moore, Irondale, AL (US)

(72) Inventors: Brian Boatner, Pontotoc, MS (US); Blake T. Hudson, Smyrna, GA (US); Hamilton G. Moore, Irondale, AL (US)

(73) Assignee: INITIATE LAUNCH, LLC, Irondale, AL (US)

( * ) Notice: Subject to any disclaimer, the term of this patent is extended or adjusted under 35 U.S.C. 154(b) by 112 days.

(21) Appl. No.: 16/740,600

(22) Filed: Jan. 13, 2020

(65) Prior Publication Data

US 2020/0147441 A1 May 14, 2020

Related U.S. Application Data

(63) Continuation-in-part of application No. 15/813,346, filed on Nov. 15, 2017, now Pat. No. 10,532,241.

(51) Int. Cl.
*A63B 21/072* (2006.01)

(52) U.S. Cl.
CPC ..... *A63B 21/0722* (2015.10); *A63B 21/0724* (2013.01); *A63B 21/0726* (2013.01)

(58) Field of Classification Search
CPC ..... A63B 21/0722; A63B 21/0724; A63B 21/0726; A63B 21/0728; A63B 2209/00; A63B 2225/10; A63B 21/07; A63B 23/12; A63B 21/40
See application file for complete search history.

(56) References Cited

U.S. PATENT DOCUMENTS 2,676,802 A * 4/1954 O'Brien ..... A63B 21/0724 482/106
3,756,597 A * 9/1973 Monti ..... A63B 21/0608 482/106
4,103,887 A * 8/1978 Shoofler ..... A63B 21/0602 482/106
4,369,968 A * 1/1983 Price ..... A63B 21/0601 482/106
4,618,142 A * 10/1986 Joseph, Jr. ..... A63B 5/20 482/106
4,709,922 A * 12/1987 Slade, Jr. ..... A63B 21/0783 482/104

(Continued)

FOREIGN PATENT DOCUMENTS

GB 2516269 1/2015
WO 2013181757 12/2013

*Primary Examiner* — Garrett K Atkinson
(74) *Attorney, Agent, or Firm* — Gardner, Groff & Greenwald, PC; Blake T. Hudson

(57) ABSTRACT

A kettle bell including a weighted mass and a handle or grasping ring extending from an upper portion of the mass, and at least one opening or receiver formed through at least a portion of the mass and/or handle. In example embodiments, the at least one opening or receiver is provided for accommodating interengagement with the end male receivers of a barbell or other exercise device. In other example embodiments, one or more portions of the kettle bell is at least partially deformable or flexible.

16 Claims, 10 Drawing Sheets

(56) References Cited

U.S. PATENT DOCUMENTS 4,756,526 A * 7/1988 Broussard ..... A63B 21/075 482/108
4,978,122 A 12/1990 Dibowski
4,998,721 A * 3/1991 Anders ..... A63B 21/0783 482/4
4,998,723 A * 3/1991 Santoro ..... A63B 21/078 482/104
5,029,849 A * 7/1991 Nurkowski ..... A63B 21/072 482/106
5,102,124 A * 4/1992 Diodati ..... A63B 21/0605 482/106
5,242,348 A 9/1993 Bates
5,310,394 A * 5/1994 Kallios ..... A63B 21/00181 482/104
5,344,375 A * 9/1994 Cooper ..... A63B 21/0728 482/106
D356,351 S * 3/1995 Watts ..... D21/691
5,692,996 A 12/1997 Widerman
5,823,921 A * 10/1998 Dawson ..... A63B 21/078 482/104
5,842,957 A * 12/1998 Wheeler ..... A63B 21/0602 482/111
5,871,423 A * 2/1999 Pruchnik ..... A63B 21/22 482/110
5,891,004 A * 4/1999 Berry ..... A63B 21/04 482/129
5,989,164 A * 11/1999 Kullman ..... A63B 21/0783 482/104
6,099,441 A * 8/2000 Bonnet ..... A63B 21/072 482/106
6,190,292 B1 2/2001 Panes
6,261,211 B1 * 7/2001 Suarez ..... A63B 21/0603 482/107
6,293,892 B1 * 9/2001 Slawinski ..... A63B 21/00181 482/104
6,379,287 B1 * 4/2002 Slawinski ..... A63B 21/00181 482/104
6,648,804 B2 * 11/2003 Chen ..... A63B 21/0004 482/125
6,746,380 B2 6/2004 Lien et al.
6,893,381 B2 * 5/2005 Slawinski ..... A63B 21/078 482/104
6,926,649 B2 * 8/2005 Slawinski ..... A63B 21/00181 482/104
7,052,445 B2 * 5/2006 Ekhaus ..... A63B 21/0601 482/108
7,198,591 B2 4/2007 Lien
7,201,711 B2 * 4/2007 Towley, III ..... A63B 21/0605 482/106
7,753,827 B1 * 7/2010 Emick ..... A63B 23/14 482/44
D635,206 S 3/2011 Henniger
D636,038 S 4/2011 Henniger
D636,039 S 4/2011 Henniger
D636,040 S 4/2011 Henniger
7,942,792 B1 5/2011 Wyman et al.
8,267,841 B1 9/2012 Allison et al.
D676,091 S 2/2013 Henniger
8,444,537 B1 * 5/2013 Santoro ..... A63B 21/0783 482/104
8,454,483 B1 * 6/2013 Bradley ..... A63B 21/072 482/92
8,568,280 B2 10/2013 Mendoza
8,585,563 B2 * 11/2013 Wilson ..... A63B 21/0724 482/93
D708,682 S * 7/2014 Jones ..... D21/680
8,784,281 B2 * 7/2014 Johnson, III ..... A63B 21/0783 482/104
8,882,642 B2 11/2014 Chavez et al.
8,911,334 B1 * 12/2014 Cotter ..... A63B 21/4005 482/111
8,944,971 B2 2/2015 Shorter
8,979,719 B2 3/2015 Januszek
D726,264 S * 4/2015 Agate ..... D21/682
9,095,742 B2 8/2015 Henniger et al.
9,126,079 B2 * 9/2015 Jordan ..... A63B 21/072
9,135,347 B2 * 9/2015 Damman ..... G06Q 50/10
9,216,315 B1 12/2015 Chang et al.
D748,212 S * 1/2016 Gangemi ..... D21/681
9,364,704 B1 6/2016 Kuka
9,409,220 B2 8/2016 Henniger et al.
9,504,866 B2 11/2016 Peralo
9,504,867 B2 11/2016 Hall
9,616,269 B1 * 4/2017 Burosh ..... A63B 21/072
9,770,619 B1 * 9/2017 Bullock ..... A63B 21/22
9,884,239 B2 * 2/2018 Kay ..... A63B 24/0087
D812,699 S * 3/2018 Thell ..... D21/680
10,369,401 B2 * 8/2019 Brown, Jr. ..... A63B 21/026
2001/0001094 A1 5/2001 Panes
2002/0198081 A1 * 12/2002 Chen ..... A63B 21/00043 482/23
2004/0077466 A1 4/2004 Wallace et al.
2006/0003874 A1 1/2006 Hamilton
2006/0035767 A1 * 2/2006 Ekhaus ..... A63B 21/0601 482/108
2007/0179030 A1 * 8/2007 Slawinski ..... A63B 21/075 482/98
2007/0287609 A1 * 12/2007 McBride ..... A63B 21/065 482/105
2011/0263393 A1 10/2011 Ross et al.
2012/0046148 A1 2/2012 Aguila
2012/0053024 A1 3/2012 Mendoza
2012/0157270 A1 6/2012 Johnson
2012/0172182 A1 7/2012 Leier et al.
2012/0184418 A1 7/2012 Wilson
2012/0244999 A1 * 9/2012 Tauriainen ..... A63B 21/0783 482/104
2012/0309595 A1 12/2012 Dike
2013/0065738 A1 3/2013 Henniger et al.
2013/0190143 A1 * 7/2013 Greenhill ..... A63B 21/0058 482/104
2013/0245611 A1 9/2013 Bonnet et al.
2013/0267390 A1 10/2013 Warren
2014/0018214 A1 * 1/2014 Jordan ..... A63B 21/0722 482/107
2014/0024507 A1 1/2014 Hagos
2014/0057767 A1 2/2014 Henniger et al.
2014/0073493 A1 * 3/2014 Parish ..... A63B 21/0783 482/104
2014/0080680 A1 3/2014 Henniger et al.
2014/0119811 A1 5/2014 Henniger et al.
2014/0141944 A1 5/2014 Johnson et al.
2014/0336021 A1 11/2014 Jones
2014/0336022 A1 11/2014 Jones
2014/0342885 A1 11/2014 Jones
2015/0011370 A1 1/2015 Henniger
2015/0133271 A1 5/2015 Jones
2015/0169763 A1 * 6/2015 Dam ..... G06Q 50/10 707/769
2015/0170530 A1 * 6/2015 Dam ..... G09B 5/00 700/91
2015/0196119 A1 7/2015 Henniger
2015/0343257 A1 12/2015 Cooper
2015/0367168 A1 12/2015 Henniger
2016/0030797 A1 2/2016 Erickson
2016/0045780 A1 2/2016 Henniger
2016/0263461 A1 * 9/2016 Kay ..... A63B 24/0087
2017/0021223 A1 * 1/2017 Ramsey ..... A63B 21/026
2017/0319895 A1 * 11/2017 Davis ..... A63B 23/1236
2018/0001132 A1 * 1/2018 Brown, Jr. ..... A63B 21/027
2018/0140890 A1 * 5/2018 Sheppard ..... A63B 21/0726
2020/0265378 A1 * 8/2020 Boatner ..... G06K 7/1413

* cited by examiner

KETTLE BELL AND METHODS OF USE THEREOF

CROSS-REFERENCE TO RELATED APPLICATION

This application is a continuation-in-part of U.S. Non-Provisional patent application Ser. No. 15/813,346 filed Nov. 15, 2017, which claims the benefit of U.S. Provisional Patent Application Ser. No. 62/422,105, filed Nov. 15, 2016, the entirety of which is hereby incorporated herein by reference.

TECHNICAL FIELD

The present invention relates generally to the field of exercise equipment, and more particularly to exercise weights or weighted objects such as a kettle bell.

BACKGROUND OF THE INVENTION

Kettle bells are commonly used for lifting in various exercises, for example, wherein the user generally grasps the kettle bell with one or more hands, and generally lifts the kettle bell in some fashion. One drawback to kettle bells is that they are generally only capable of being grasped, for example, wherein a handle generally extends from a portion of the kettle bell that is sized and shaped for being grasped by one or more hands of a user. Continuous improvements to kettle bells are sought. It is to the provision of an improved kettle bell and methods of use thereof meeting these and other needs that the present invention is primarily directed.

SUMMARY OF THE INVENTION

In example embodiments, the present invention provides a kettle bell and methods of using the kettle bell. According to one example embodiment, the invention includes a kettle bell comprising a weighted base portion, a grasping handle extending from the base portion for receiving one or more hands of the user or lifter, and a conduit or opening extending through the base portion. In example embodiments, the opening of the base portion is generally cylindrical in shape, and is generally sized for receiving an end collar member of a barbell. Optionally, the opening generally extends entirely through at least a portion of the weighted member, and is shaped as desired (e.g., hexagonal, polygonal, triangular, oval, etc.).

In one aspect, the present invention relates to a kettle bell including a generally spherical shaped weighted mass, a generally flat bottom for resting atop a support surface, a handle extending from an upper portion of the mass to form a loop-like grasping ring, and an opening extending entirely through a generally central area of the mass. In example embodiments, the opening is provided for accommodating interengagement with the end male receivers of a barbell In another aspect, the invention relates to a method of using a kettle bell for exercising. The method includes providing a kettle bell, the kettle bell having a weighted mass, a handle extending from an upper portion of the mass to form a grasping ring, and at least one receiver opening; grasping the grasping ring of the kettle bell with one or more hands of a user; performing one or more exercises; providing a barbell comprising male collar end receivers; removably attaching a kettle bell to each of the collar end receivers, wherein the collar end receivers are fitted through the at least one receiver opening of each kettle bell; and performing one or more exercises by grasping and lifting the barbell.

In example embodiments, the at least one receiver opening is at least partially formed in the weighted mass. In example embodiments, wherein the at least one receiver opening is at least partially formed in the handle. In example embodiments, wherein the weighted mass includes a generally flat bottom for resting atop a support surface. In example embodiments, wherein at least the spherical shaped weighted mass includes iron. In example embodiments, wherein the kettle bell includes a total weight of between 5-115 pounds. In example embodiments, wherein the kettle bell further includes a clasp or fastener for securing the kettle bell to the collar end of the barbell.

In another aspect, the invention relates to a multi-use exercise device including a weighted mass and a grasping ring extending from the base and including a grasping portion and extension portions extending from the grasping portion. The extension portions each including a collar member having an opening extending therethrough, the opening of each collar member configured for receiving a collar end of a barbell such that the weighted mass is removably mountable to the collar end of the barbell.

In example embodiments, the weighted mass includes a pair of receivers and the extension portions of the grasping ring include extension ends for engagement with the receivers of the weighted mass. In example embodiments, at least the weighted mass includes iron. In example embodiments, the multi-use exercise device has a total weight of between 5-115 pounds. In example embodiments, the weighted mass includes a generally flat bottom for resting atop a support surface.

In yet another aspect, the invention relates to a kettle bell including a generally spherical shaped weighted mass, a handle extending from an upper portion of the mass to form a grasping ring, and at least one receiver opening configured for attachment of the kettle bell to a collar end of a barbell.

In example embodiments, the at least one receiver opening is at least partially formed in the generally spherical shaped weighted mass. In example embodiments, the at least one receiver opening is at least partially formed in the grasping ring. In example embodiments, the weighted mass includes a generally flat bottom for resting atop a support surface. In example embodiments, at least the spherical shaped weighted mass includes iron. In example embodiments, the kettle bell comprises a total weight of between 5-115 pounds.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 16 shows a side view of a kettle bell according to another example embodiment of the present invention.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

In example embodiments, the present invention provides a kettle bell and methods of using the kettle bell. According to one example embodiment, the invention includes a kettle bell comprising a weighted base portion, a grasping handle extending from the base portion for receiving one or more hands of the user or lifter, and a conduit or opening extending through the base portion. In example embodiments, the opening of the base portion is generally cylindrical in shape, and is generally sized for receiving an end collar member of a barbell. Optionally, the opening generally extends entirely through at least a portion of the weighted member, and is shaped as desired (e.g., hexagonal, polygonal, triangular, oval, etc.).

Figure 2:
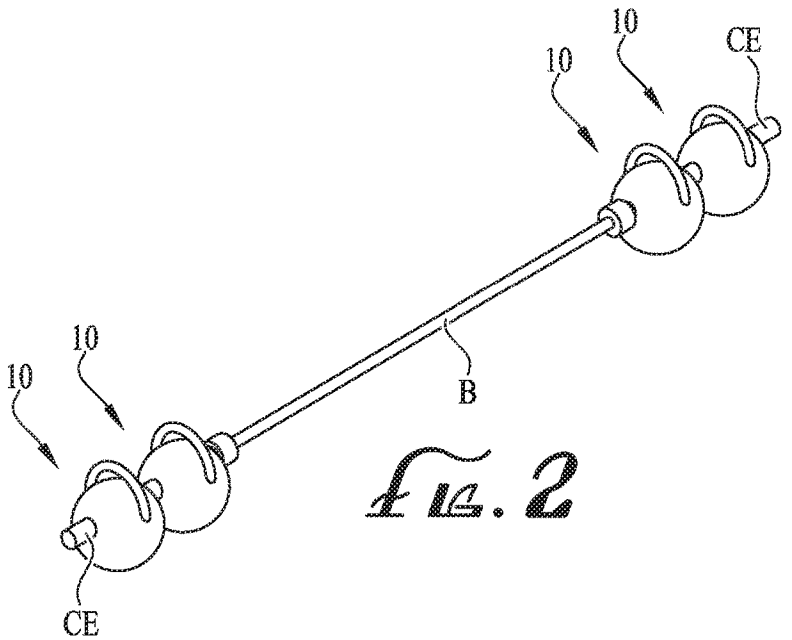
FIG. 2 is a perspective view of a weight assembly according to example embodiments of the present invention, showing a barbell having kettle bells removably attached to the ends thereof.
Figure 3:
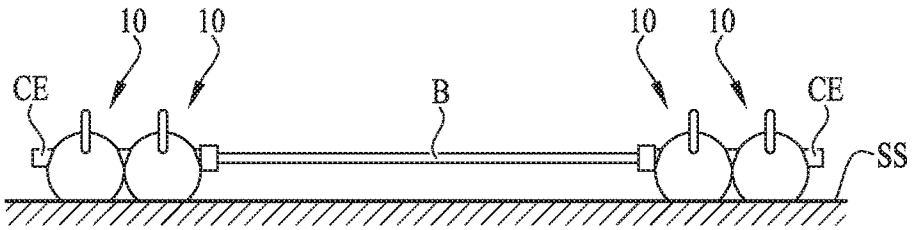
FIG. 3 is a front view of the weight assembly of FIG. 2.
Figure 1:
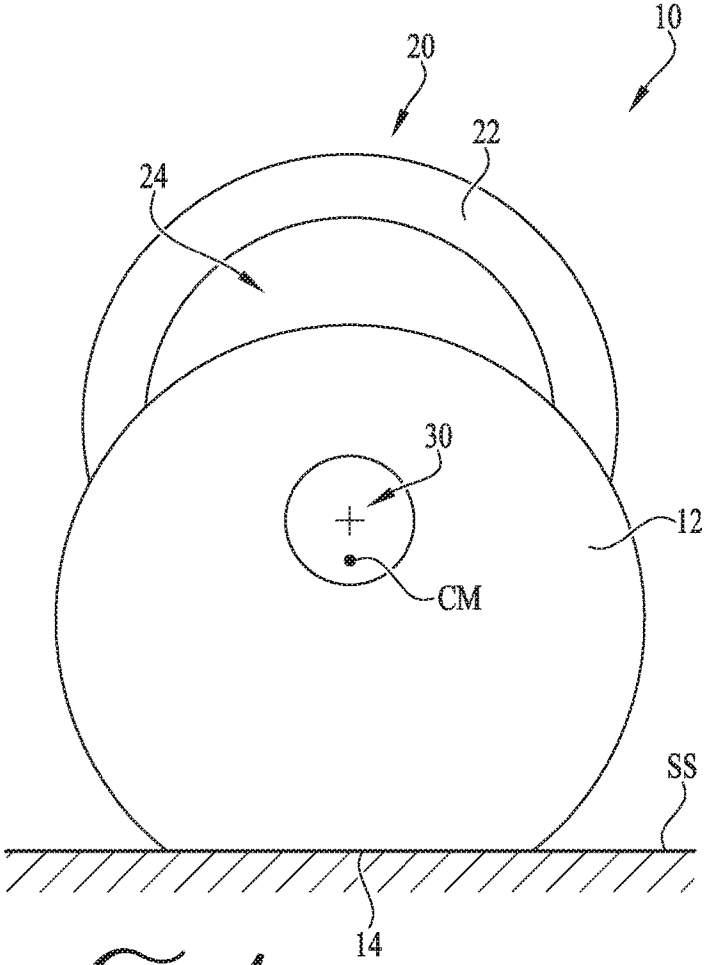
FIG. 1 is a front view of a kettle bell according to an example embodiment of the present invention.

With reference now to the drawing figures, wherein like reference numbers represent corresponding parts throughout the several views, FIG. 1 shows a kettle bell 10 according to an example embodiment of the present invention. As depicted, the kettle bell 10 comprises a generally spherical shaped weighted mass or object 12, with a generally flat bottom 14 for resting atop a support surface SS, and a handle 20 extending from an upper portion of the mass 12 to form a loop-like grasping ring 22. In alternate example embodiments, the weighted mass or object 12 can be shaped as desired. In example embodiments, an opening 24 is defined between the ring 22 and the upper portion of the mass 12. In preferred example embodiments, an opening 30 extends entirely through a generally central area of the mass 12, for example, to provide for accommodating interengagement with the end male receivers or collar ends CE of a barbell B. For example, as depicted in FIGS. 2-3, each of the collar ends CE of the barbell B are engaged with two kettle bells 10, for example, to provide an alternative option for adding additional weight to the collar ends CE of the barbell B, for example, rather than utilizing standard plate or disc-shaped weights. According to example embodiments, the barbell B with one or more of the kettle bells 10 removably engaged at each collar end CE can be used by the user, for example, to perform dead lift exercises, or for example, a bench-type chest exercise, a shoulder press exercise, or additional types of exercises as desired.

In example embodiments, the collar ends CE of the barbell comprise a diameter of about 50 millimeters or about 2 inches, and the opening 30 comprises a diameter that is at least partially larger than the collar end CE diameter such that the collar end CE can slidingly engage with the opening 30. In some example embodiments, the opening can be substantially larger than the diameter of the collar end CE, and one or more frictional pads or inserts can be provided for allowing a generally tight-fitting engagement. Optionally, a rubber sleeve can be provided on the collar ends CE, and the opening 30 is generally sized to fit over the rubber sleeve.

As depicted in FIG. 1, the opening 30 is generally formed through the entirety of at least a portion of the mass 12. In example embodiments, the opening 30 is generally positioned at least partially above the center of mass CM of the kettle bell 10. As such, when the kettle bell 10 is removably mounted to the collar end CE, the kettle bell 10 remains oriented upright (due to the center of mass CM being positioned below the center of the opening 30), for example, such that the bottom 14 remains generally parallel with the support surface SS.

Figure 4:
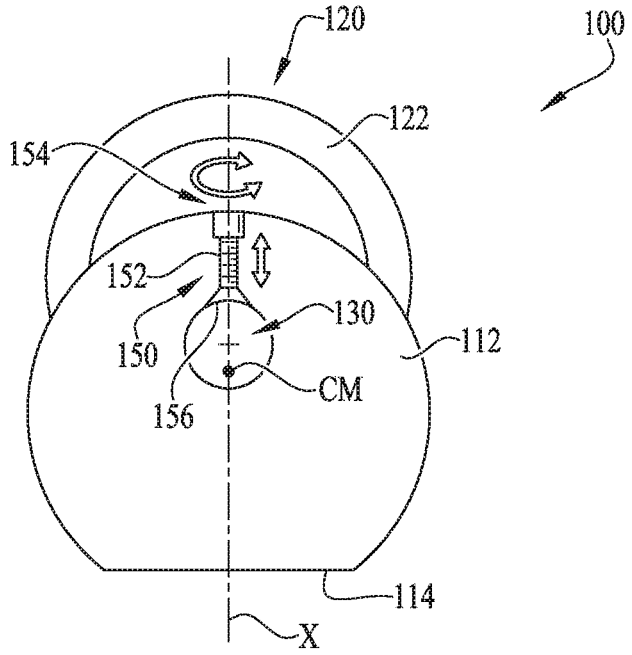
FIG. 4 is a front view of a kettle bell according to another example embodiment of the present invention.

FIG. 4 shows a kettle bell 100 according to another example embodiment of the present invention. As depicted, the kettle bell 100 is substantially similar to the kettle bell 10 as described above. For example, the kettle bell 100 generally comprises a generally spherical shaped weighted mass or object 112, with a generally flat bottom 114 for resting atop a support surface SS, and a handle 120 extending from an upper portion of the mass 112 to form a loop-like grasping ring 122. Similarly, an opening 130 extends entirely through the mass 112, for example, such that the center of the opening 130 is generally positioned at least partially above the center of mass CM of the mass 112. According to example embodiments, a retaining mechanism or stop member 150 is provided with the mass 112, which comprises a central shaft 152 extending between an adjustment portion 154 and an engagement portion 156. In example embodiments, the adjustment portion 154 can be rotated about axis X, which provides for translation (up and down) of the engagement portion 156 into and out of the opening 130. For example, after the collar end CE is fitted through the opening, the adjustment portion 154 can be rotated to cause frictional engagement of the engagement portion 156 with an outer periphery of the collar end CE.

Thus, the retaining mechanism 150 preferably provides for securing the kettle bell 100 to the collar end CE, thereby preventing the kettle bell 100 from unintentional disengagement from the collar end CE during use. In some example forms, the engagement portion 156 is generally curved or radiused to follow the curvature of the opening 130, for example, such that in a fully retracted position, the collar end CE is slidably engageable with the opening. Further, when the engagement portion 156 is in an engaged position, the curved surface of the engagement portion 156 is generally substantially frictionally engaged with an outer periphery portion of the collar end CE. Optionally, the engagement portion 156 can be shaped as desired for providing engagement with the collar end CE. Optionally, other retaining mechanisms, fasteners, coupling members, etc. can be used as desired, for example, to provide for removably attaching the kettle bell 100 to the collar end CE. In example embodiments, the engagement portion can be formed from a rubber or high friction material, for example, for increasing the frictional engagement with the outer periphery of the collar end CE.

Figure 5:
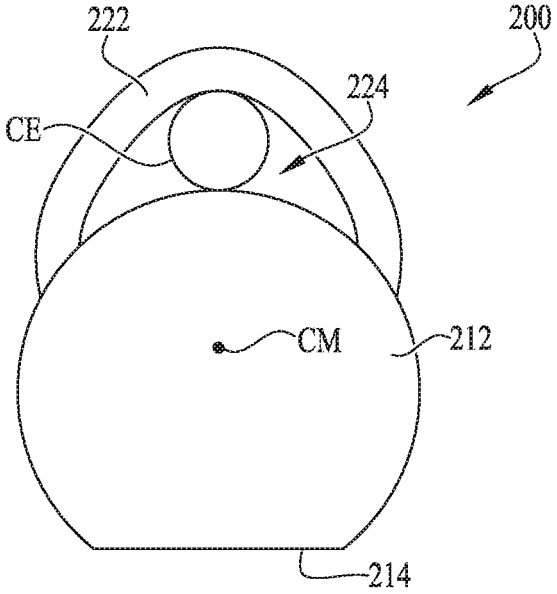
FIG. 5 is a front view of a kettle bell according to another example embodiment of the present invention.

FIG. 5 shows a kettle bell 200 according to another example embodiment of the present invention. As depicted, the kettle bell 200 is substantially similar to the kettle bell 10 as described above. According to one example form, the grasping handle or ring 222 is preferably sized and shaped such that the opening 224 that is defined between the ring 222 and the mass 212 can receive the collar end CE. Thus, rather than removable attachment of the kettle bell with the collar end CE by providing an opening within the mass, the opening 224 defined between the ring 222 and the mass 212 is sized and shaped to receive the collar end CE or to be grasped by one or more hands us a user. Preferably, one or more retaining members, fasteners, couplings, etc. can be provided for removably securing the kettle bell 200 to the collar end CE.

Figure 6:
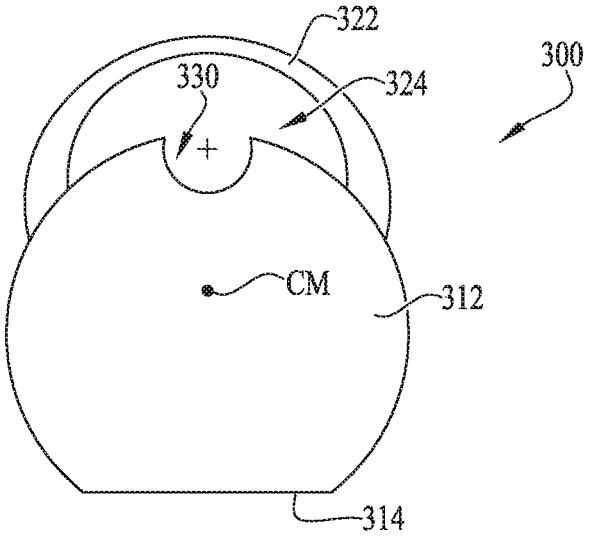
FIGS. 6-8 show a kettle bell according to another example embodiment of the present invention.
Figure 7:
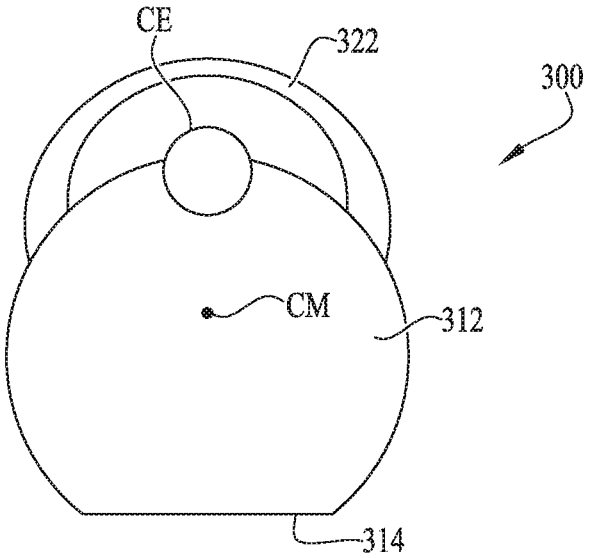
Figure 8:
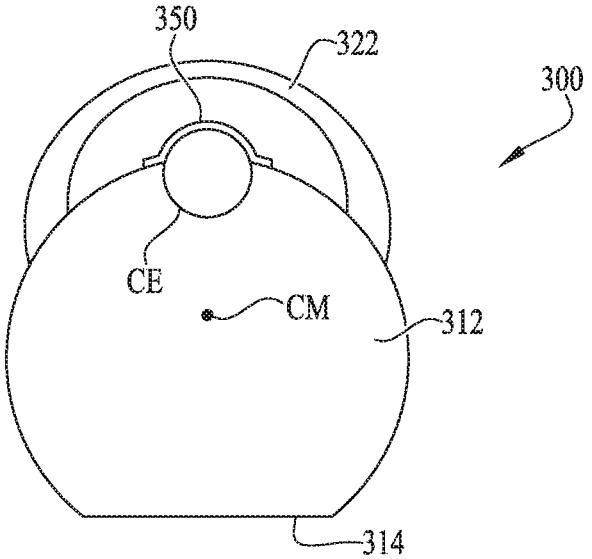

FIGS. 6-8 show a kettle bell according to another example embodiment of the present invention. As depicted, the kettle bell 300 is substantially similar to the kettle bell 10 as described above. In example embodiments, an opening 330 extends entirely through an upper portion of the mass 312, which provides for receiving the collar end CE of the barbell B. In example embodiments, the opening 330 is positioned substantially above the center of mass CM of the mass 312. In example embodiments, the center of the opening 330 is generally configured to be at least partially below the outer peripheral surface of the mass 312. Thus, the opening 330 defines a U-shaped channel, which is at least partially more than half of a circle (e.g., greater than 180 degrees) such that the collar end CE is prevented from disengaging the kettle bell 300 during use. Accordingly, the collar end CE is permitted to slidingly engage with the opening 330 of the kettle bell 300 during attachment or detachment thereof, however, as the opening 330 is generally at least partially greater than 180 degrees, the collar end CE is incapable from disengaging the opening 330 during use (e.g., lifting the barbell B when one or more kettle bells 300 are removably attached). According to one example embodiment, a clasp or fastener 350 can be provided for further securing the collar end CE to the kettle bell 300, or for example, for further securing the kettle bell 300 to the collar end CE.

In example embodiments, the kettle bell 10 is generally formed from a cast iron material, or can optionally be formed with other dense metals or other materials, sand, etc. Preferably, the total weight of the kettle bell 10 is generally between 5-115 lbs. According to some example embodiments, the kettle bell 10 can be configured to be weighted generally similar to known disc-shaped weights, for example, between about 5-45 lbs. Optionally, as described above, the kettle bell 10 can be weighted as desired, for example, which can be more than 45 lbs.

According to another example embodiment, the present invention relates to a method of using a kettle bell for exercising. The method includes providing a kettle bell, the kettle bell comprising a generally spherical shaped weighted mass, a generally flat bottom for resting atop a support surface, a handle extending from an upper portion of the mass to form a loop-like grasping ring, and an opening extending entirely through a generally central area of the mass; grasping the kettle bell with one or more hands of a user; performing one or more exercises; providing a barbell comprising male collar end receivers; removably attaching a kettle bell to each of the collar end receivers, wherein the collar end receivers are fitted through the opening of each kettle bell; and performing one or more exercises by grasping and lifting the barbell.

According to another example embodiment, an engagement clasp, ring, or other connector can be provided, for example, for removably attaching the kettle bell to the collar end of the barbell. For example, rather than engaging the collar end CE with an opening formed through the mass or through the opening defined between the grasping ring and the mass, a separate attachment ring or coupling member can accommodate attachment of the kettle bell with the collar end CE of the barbell B. According to one example embodiment, the coupling member is configured for both removably engaging the collar end of the barbell B and for coupling to a portion of the kettle bell. In example forms, the coupling member can provide for removable engagement with the grasping ring of the kettle bell. In some example embodiments, on or more fasteners, clips, latch mechanisms, couplings, etc. provide for removably securing the kettle bell to the collar ends of the barbell B.

According to another example embodiment, the present invention relates to a retrofitted kettle bell, which can be used for grasping by one or more hands of a user to perform one or more exercises, or for removably attachment to collar ends of a barbell for performing one or more exercises utilizing the barbell. Thus, in example embodiments, a user can utilize one or more retrofitted kettle bells for performing a plurality of different exercises (with or without a barbell B), for example, rather than only being able to utilize the kettle bell for user-performed exercises where the user grasps the handle with one or more hands.

Figure 9:
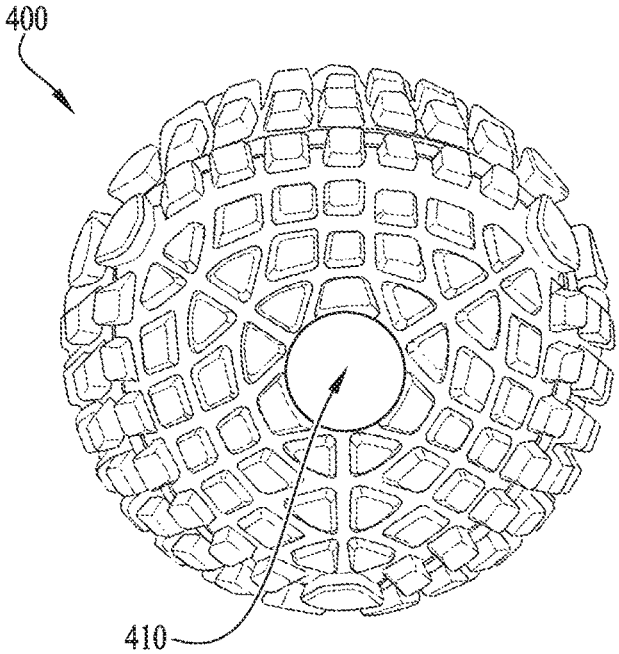
FIGS. 9-11 show a multi-use weighted exercise device according to another example of the present invention.
Figure 10:
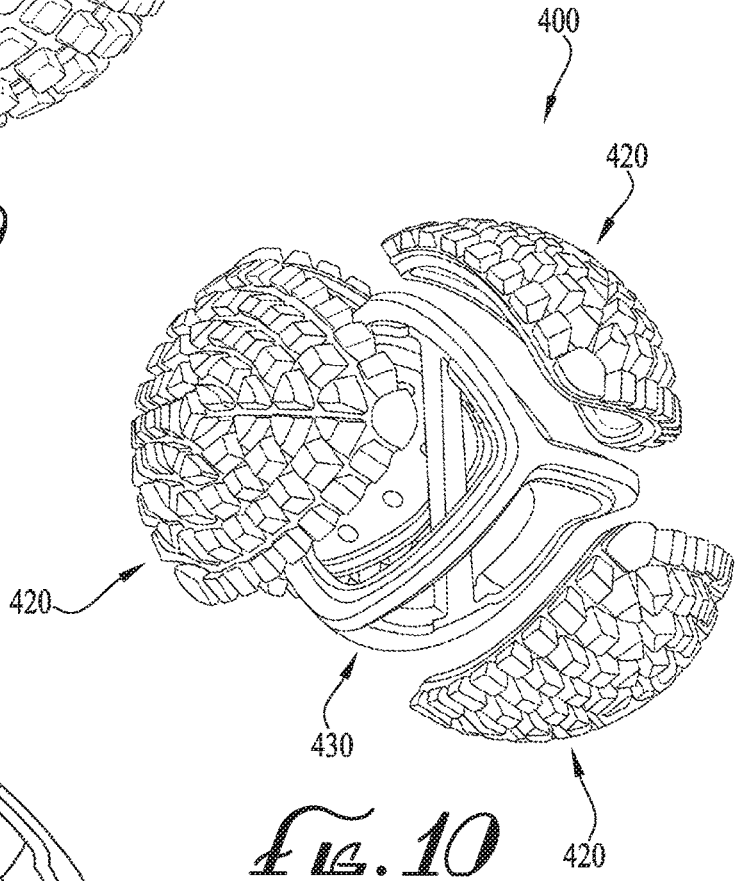
Figure 11:
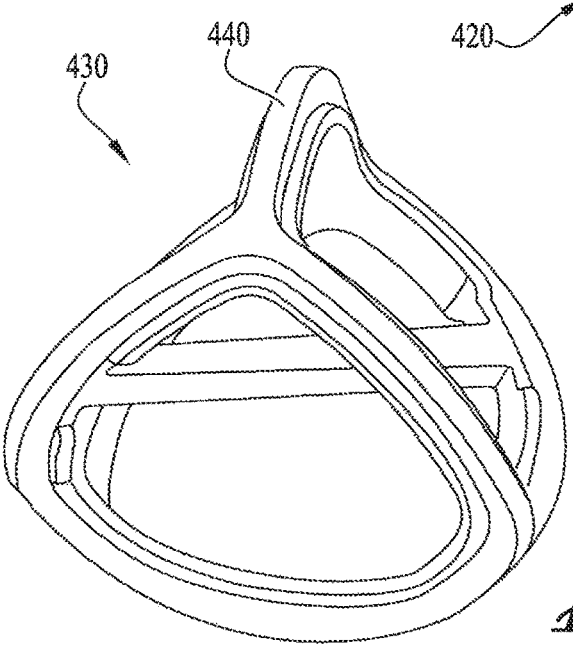

According to another example embodiment, the present invention comprises an exercise device, for example, an exercise ball device, or for example, a weighted, multi-use exercise ball 400 (see FIGS. 9-11). For example, according to example embodiments, the device 400 can be used for manual interaction with a user (e.g., like a medicine ball), or for example, the ball (or portions thereof) can be used for attachment to a collar end CE of a barbell. In example embodiments, the device 400 comprises a generally cylindrical opening 410 extending through the entirety of the device 410, for example, which is preferably sized and shaped for receiving the collar end CE of a barbell B. According to example embodiments, as depicted in FIG. 10, the device 400 generally comprises a plurality of panels or shells 420 for removable attachment to a frame component 430. U.S. Patent Application No. 2014/0336021 is incorporated by reference herein in its entirety and discloses an exercise device having a frame and multiple panels for attachment to the frame. According to one example embodiment, the opening 410 is formed by a plurality of cutouts formed in the shells 420, for example, such that assembly and attachment of the shells 420 to the frame 430 defines the opening 410. According to example embodiments, the frame 430 can further be utilized as a kettle bell, for example, wherein one or more weighted components or members can be attached to the frame, and wherein a portion of the frame 430 can be grasped by one or more hands of the user (see handle 440). According to example embodiments, the shells 420 can be weighted as desired, for example, being formed from a metal, non-metal or other dense material. According to another example embodiment, the frame 430 (and one or more weights attached to the frame 430) can be configured for attachment to the collar end CE of a barbell B.

Optionally, rather than removably engaging the kettle bells or exercise device with the collar ends CE of a barbell, a curl bar can be utilized, for example, which comprises similar sized collar ends for sliding engagement with the opening of the kettle bell or exercise device.

Figure 12:
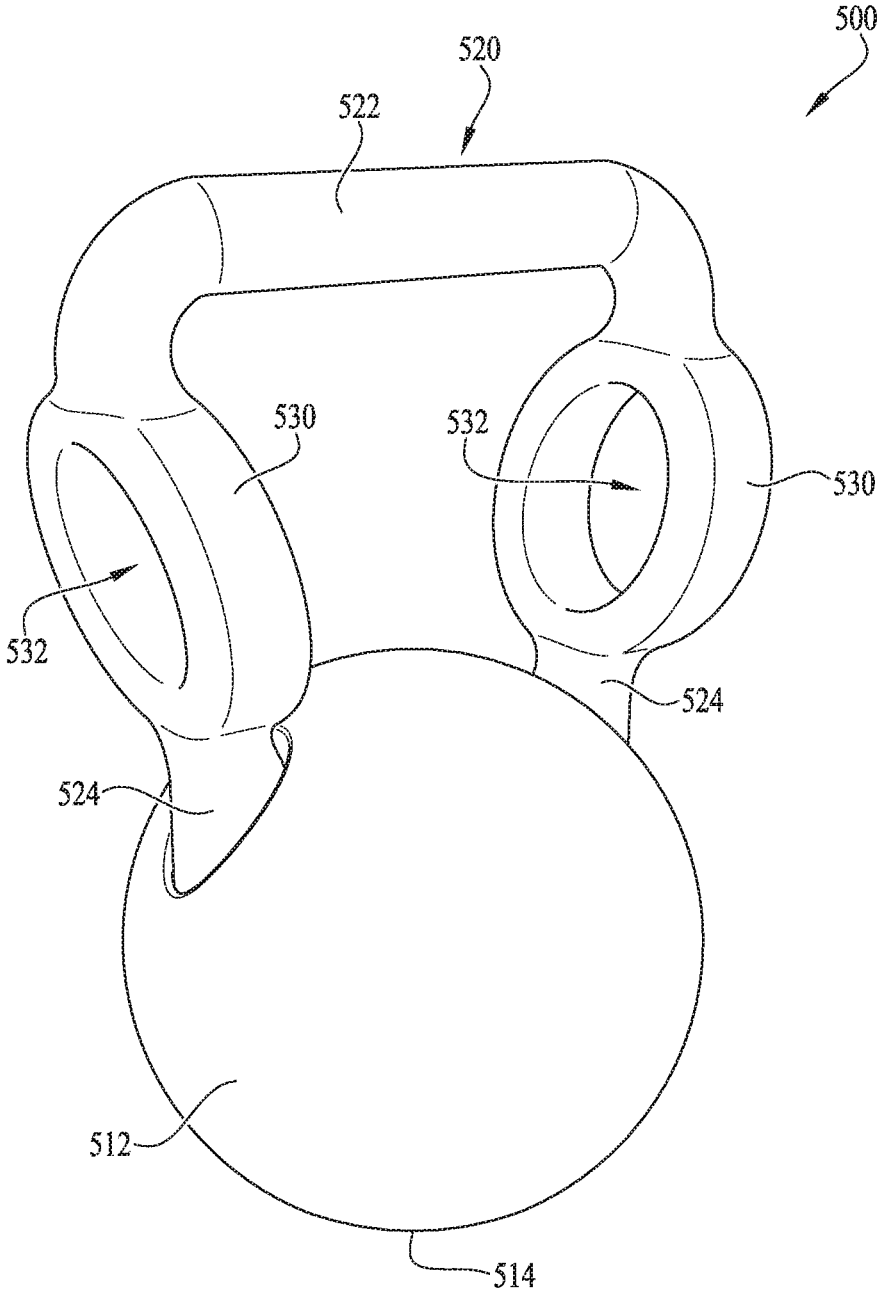
FIGS. 12-14 show a kettle bell according to another example embodiment of the present invention.
Figure 13:
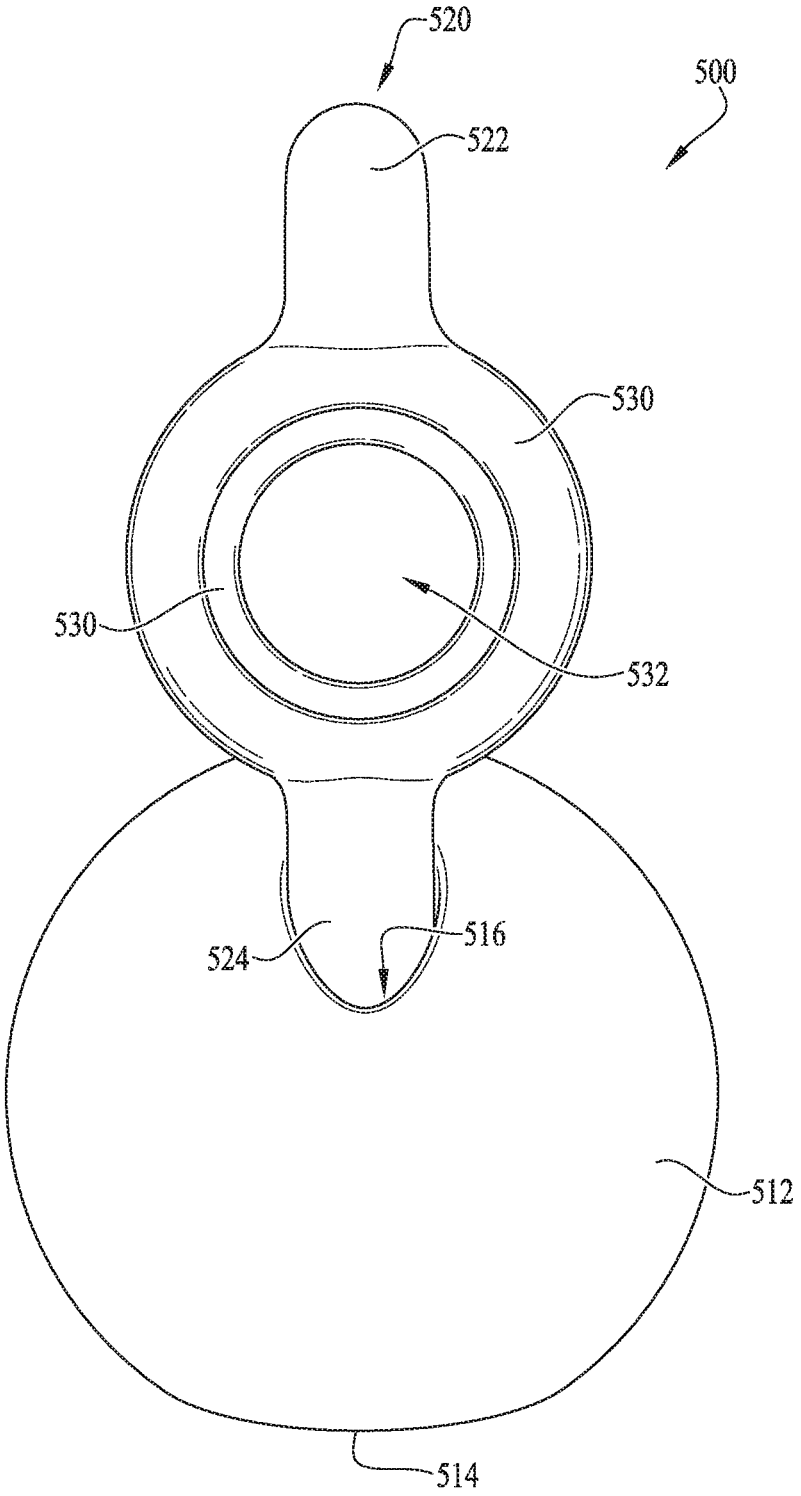
Figure 14:
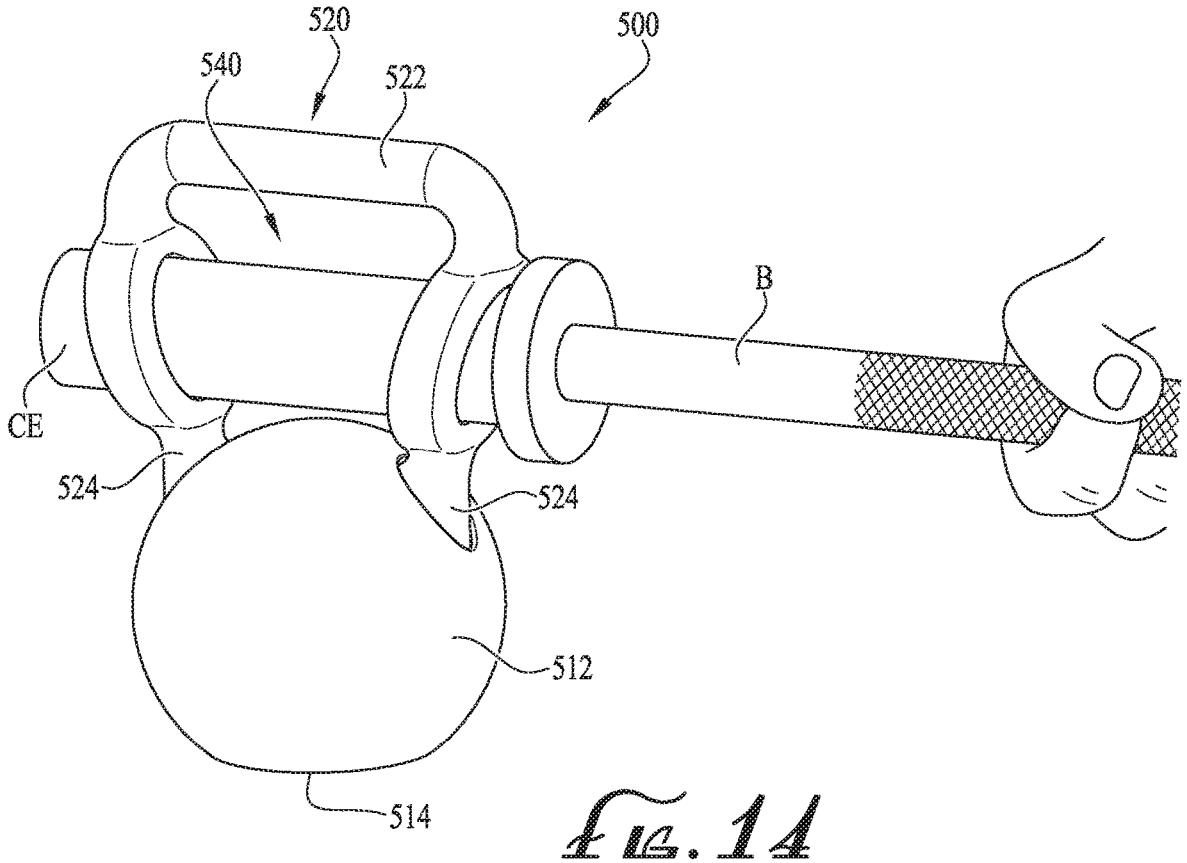

According to one example embodiment of the present invention, the grasping ring of the kettle bell can comprise two generally spaced-apart rings, which are generally integrally formed with the handle, and which are sized and shaped for receiving the collar ends CE of the barbell B. For example, as depicted in FIGS. 12-14, the kettle bell 500 comprises a base portion or mass 512 and a grasping ring 520, and a ring or collar member 530 is provided on each extension portion extending from the grasping handle 522. In example embodiments, the collar members 530 define receivers or openings 532 passing therethrough, for example, such that the collar end CE of a barbell B is removably engagable with the collar members 530 of the grasping ring 520, for example, wherein the openings 532 are generally sized to permit insertion of the collar end CE therethrough. In example embodiments, the grasping ring 520 can be grasped for manual exercise (e.g., the grasping handle 522) or can removably engage the collar end CE of a barbell B, or for example, other collar ends CE as described herein, for example, a curling bar, shorter barbell or other bar or device comprising one or more collar ends CE. Preferably, the base portion or mass 512 can be shaped as desired.

As depicted in FIG. 13, the mass 512 comprises a pair of receivers 516 for receiving extension ends 524 of the extensions of the grasping handle 522. In some example embodiments, the grasping ring 520 and mass 512 are separately formed and permanently connected together. In other example embodiments, the grasping ring 520 and mass 512 can be configured for removable coupling engagement, for example, such that one or more other grasping rings can be interchanged with the mass 512, for example, to provide additional functionality and/or connectability. According to another example embodiment, the grasping ring and the mass can be integrally formed together as one piece, for example, by a cast, molding, or other available manufacturing process.

As depicted in FIG. 14, the kettle bell 500 is removably mounted to a collar end CE of a curl bar. Preferably, according to example embodiments of the invention, an opening or pass-through 540 is defined between the grasping handle 522 and the collar end CE. Preferably, the pass-through 540 allows for grasping of the grasping handle 522 when the kettle bell 500 is removably mounted to the collar end CE, for example, such that the user can easily remove or place the kettle bell on the collar end CE as desired.

As described above and according to example embodiments, the kettle bell 500 is generally formed from a cast iron material, or can optionally be formed with other dense metals or other materials, sand, etc. According to other example embodiments, the kettle bell 500 can be formed from one or more materials as desired. According to some example embodiments, substantially dense pellets or other small spherical members or other media can be filled within a reservoir defined by at least a portion thereof. In some example embodiments, the dense pellets comprise a high packing factor, for example, to maximize the amount of pellets that can be contained within the reservoir. According to example embodiments, the total weight of the kettle bell 500 is generally between 5-115 lbs. According to some example embodiments, the kettle bell 500 can be configured to be weighted generally similar to known disc-shaped weights, for example, between about 5-45 lbs. Optionally, as described above, the kettle bell 500 can be weighted as desired, for example, which can be more than 45 lbs.

According to additional example embodiments, one or more kettle bells can be removably mounted and temporarily secured to the male receivers or collar ends of a barbell or other exercise equipment (free weight and/or exercise machine) as desired. For example, according to some example embodiments, one or more kettle bells comprising a receiver opening can be configured for removable attachment to a male portion (e.g., for receiving one or more weights) of an exercise machine. For example, where the exercise machine comprises a male portion or shaft that is generally used for receiving one or more disc weights, one or more kettle bells comprising the at least one receiver opening or other male attachment member or mechanism can be removably mounted to the male portion of the exercise machine. According to further example embodiments, one or more additional accessories or other members, mechanisms, clamps, clips, rings, clasps, or other features formed with the bell or separate and mountable to the kettle bell can provide for removable mounting thereof to a barbell or other free weight bar or exercise machine. In example embodiments, a separate piece is provided such that the kettle bell can be retrofitted for removable and secure attachment to a barbell or other free weight bar or exercise equipment.

Figure 15B:
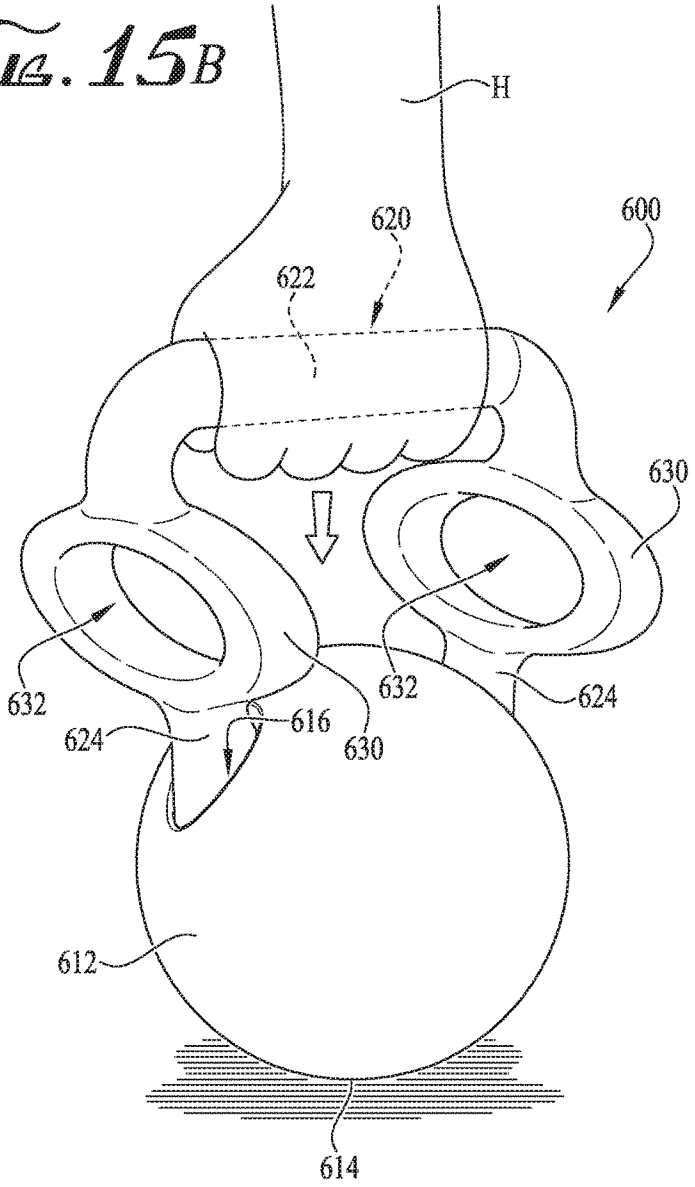
FIG. 15B shows a front perspective view of the kettle bell of FIG. 15A, and showing a user grasping a portion of the kettle bell and causing deformation of the same according to another example embodiment of the present invention.
Figure 15A:
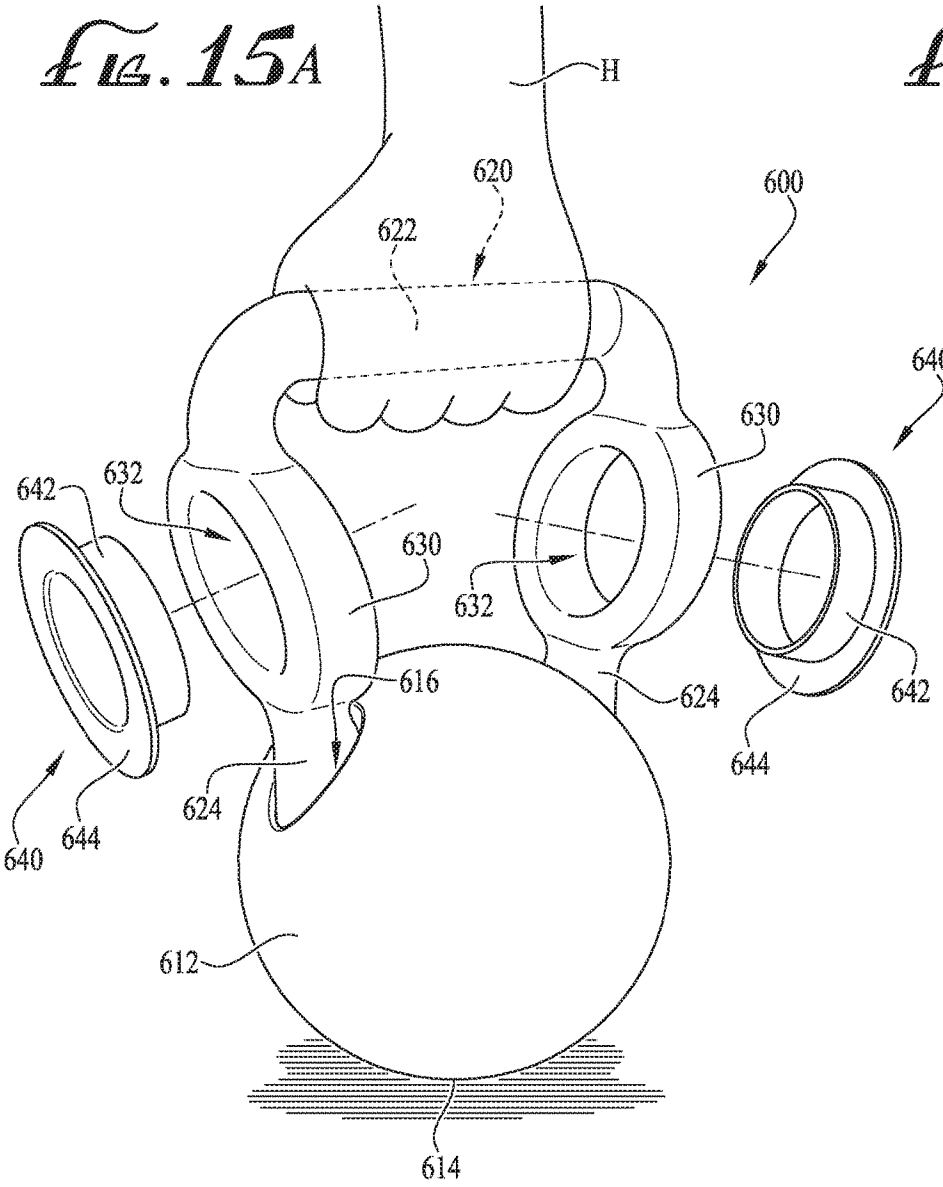
FIG. 15A shows a front perspective view of a kettle bell according to another example embodiment of the present invention, and showing removable stiffening components for insertion collar members of the grasping ring thereof.
Figure 10:
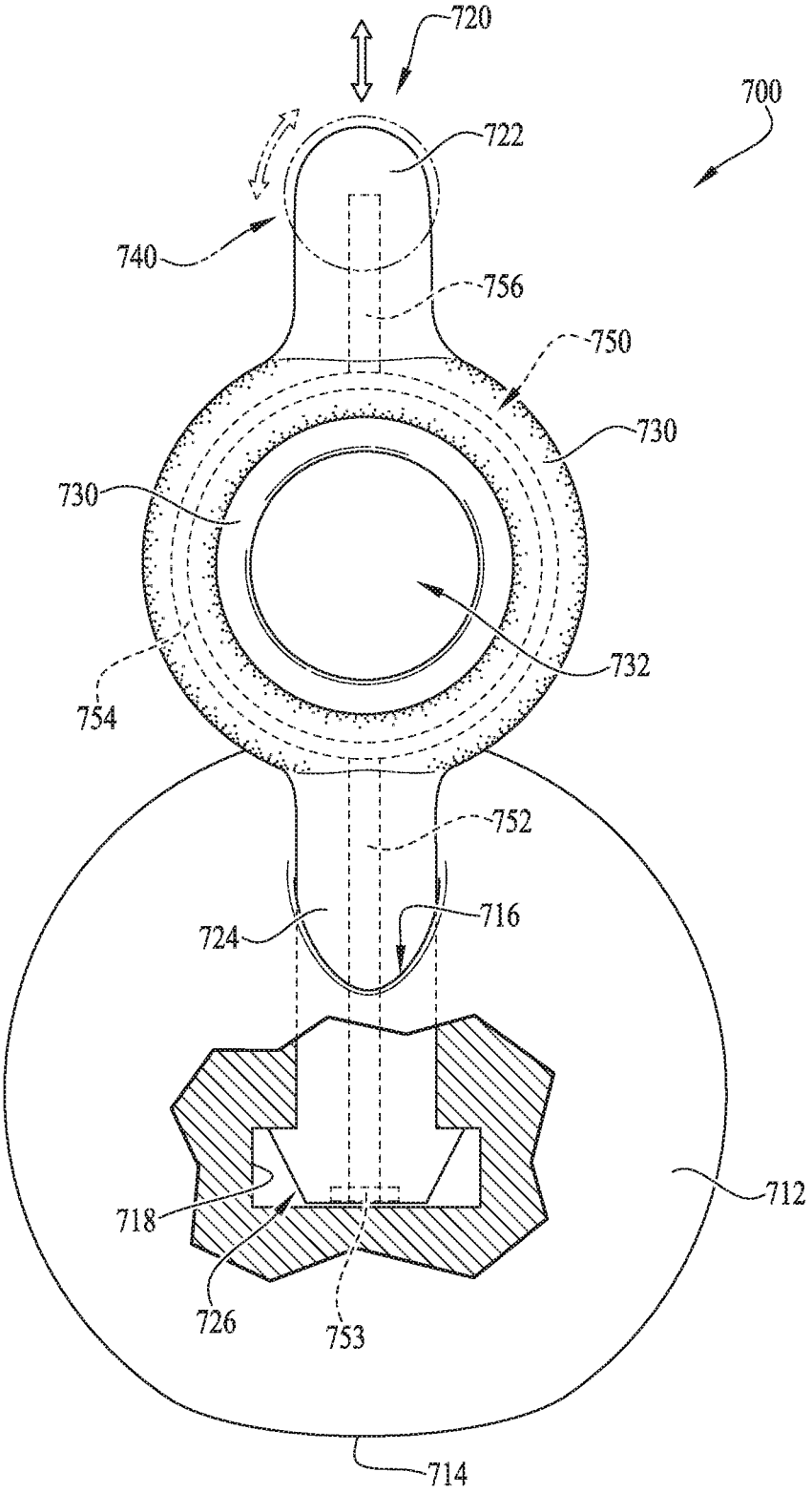

FIGS. 15A-B show a kettle bell 600 according to another example embodiment of the present invention. As depicted, the kettle bell 600 is generally similar to the kettle bell 500 as described above. According to example embodiments, the kettle bell 600 comprises a base portion or mass 612 and a grasping ring 620, and a ring or collar member 630 is provided on each extension portion extending from the grasping handle 622. In example embodiments, the collar members 630 define receivers or openings 632 passing therethrough, for example, such that the collar end CE of a barbell B is removably engageable with the collar members 630 of the grasping ring 620, for example, wherein the openings 632 are generally sized to permit insertion of the collar end CE therethrough. In example embodiments, the grasping ring 620 can be grasped for manual exercise (e.g., the grasping handle 622) or can removably engage the collar end CE of a barbell B, or for example, other collar ends CE as described herein, for example, a curling bar, shorter barbell or other bar, device or exercise equipment comprising one or more collar ends CE. Preferably, the base portion or mass 612 can be shaped as desired.

In example embodiments, the mass 612 comprises a pair of receivers 616 for receiving extension ends 624 of the extensions of the grasping handle 622. In some example embodiments, the grasping ring 620 and mass 612 are separately formed and permanently connected together. In other example embodiments, the grasping ring 620 and mass 612 can be configured for removable coupling engagement, for example, such that one or more other grasping rings can be interchanged with the mass 612, for example, to provide additional functionality and/or connectability. According to another example embodiment, the grasping ring 620 and the mass 612 can be integrally formed together as one piece, for example, by a cast, molding, or other available manufacturing process. According to one example embodiment, the entirety of the grasping ring 620 is formed from a flexible and/or resiliently deformable material, for example, so as to impart at least some deformation of the handle during use. For example, as depicted in FIG. 15B, a user is grasping the grasping handle 622 and applying a downward force, for example, such that the collar members 630 become at least partially deformed and with the openings 632 thereof becoming noncircular or at least partially irregular in shape. According to example embodiments, for example, when the kettle bell 600 is being used for manually lifting (e.g., swinging the kettle bell), the user (while grasping the kettle bell) moves the kettle bell in a pendulum motion from between the knees to anywhere between eye level to fully overhead. Preferably, during the manual lift/swing, the collar members 630 at least partially deform between a neutral state (e.g., zero to minimal force being applied to the kettle bell and/or handle) and a deformed state (e.g., at least some force being applied to the kettle bell and/or handle). As such, the kettle bell 600 is preferably configured so as to impart at least some dynamic movement during its use. According to one example embodiment, at least a portion of the grasping ring 620 is at least partially resiliently deformable relative to the mass 612. According to one example embodiment as described above, the entirety of the grasping ring 620 is formed from a flexible/deformable material. According to another example embodiment, the grasping handle 622 and the extension ends 624 are substantially rigid while the collar members 630 are at least partially flexible/deformable. According to yet another example embodiment, one or more portions of the grasping ring 620 are flexible/deformable, for example, which can be provided at the grasping handle 622, the collar members 630, the extension ends 624, where the grasping handle 622 connects to the collar members 630, where the collar members 630 connect to the extension ends 624, and/or where the extension ends 624 connect to the receivers 616.

According to one example embodiment, the collar members 630 at least partially deform while the user is performing an exercise therewith. For example, while performing a kettle bell swing, the upward pendulum motion of the kettle bell exerts a force on the collar members 630, for example, which cause the same to at least partially deform, for example, so as to cause at least some displacement between the grasping handle 622 and the mass 612. In example embodiments, the collar members 630 can be configured so as to impart a minimal, maximum or some amount deformation defined therebetween. In example embodiments, the material thereof and/or the size, shape, etc. of the collar members 630 (or other portions thereof) can be chosen as desired, for example, to provide a desired amount of deformation thereto. According to example embodiments, the grasping ring 620 (or various portions thereof) can be formed from one or more materials including rubber, rubber-like materials, polymers, synthetic materials, natural materials, composites, wood, metals and/or combinations thereof. Preferably, the grasping ring 620 (or any portions thereof) can comprise a desired modulus of elasticity, for example, a low modulus (e.g., substantially flexible), a medium modulus (e.g., at least partially flexible) or a high modulus (e.g., stiff). According to one example embodiment, at least a portion of the grasping ring 620 can comprise one or more portions that are co-molded and/or over-molded, for example, such that two or more materials are used to construct the same.

As similarly described above, the kettle bell 600 can be removably mounted to a collar end CE of an exercise device or equipment. Preferably, according to example embodiments of the invention, an opening or pass-through is defined between the grasping handle 622 and the collar end CE. Preferably, the pass-through allows for grasping of the grasping handle 622 when the kettle bell 600 is removably mounted to the collar end CE, for example, such that the user can easily remove or place the kettle bell on the collar end CE as desired.

Referring back to FIG. 15A, according to some example embodiments a pair of inserts 640 can be provided for removable engagement with the collar members 630 of the grasping ring 620. For example, when it is desired to prevent deformation of the collar members 630, inserts or stiffening components 640 can be removably mounted thereto such that the collar members 630 remain rigid and do not deform or flex during use. According to one example embodiment, each stiffening component 640 comprises a central male ring 642 (for insertion within the opening 630) and an outer flange portion 644 generally extending outwardly for seating against at least a portion of the collar member 630. According to other example embodiments, the stiffening components 640 can preferably be shaped, sized and configured as desired, for example, so as to provide for removable engagement with at least a portion of the collar members 630 (or other portions of the grasping ring 620) so as to act as a stiffening agent or component to make the grasping ring 620 (or other portions thereof) substantially, if not entirely rigid. According to some example embodiments, the stiffening components 640 can comprise one or more clips, clasps, engagement components or other engagement features, for example, so as to ensure that they remain removably engaged with the collar members 630 during use. According to some example embodiments, the stiffening components 640 can be formed from one or more materials including metals, non-metals, composites, plastics, polymers, rubber, synthetic materials, natural materials, wood and/or combinations thereof. According to some example embodiments, the stiffening components 640 can additionally be weighted as desired, for example, such that the weight of the kettle bell 600 is adjustable. For example, according to some example embodiments, the stiffening components 640 can be provided is a plurality of densities, for example, such that a user can increase the weight of the kettle bell 600 as desired. According to some example embodiments, the stiffening components comprise a high modulus of elasticity, and thus, are substantially stiff. According to other example embodiments, the stiffening components comprise a low to medium modulus of elasticity, and thus, can resiliently deform to some extent.

FIG. 16 shows a kettle bell 700 according to another example embodiment of the present invention. In example embodiments, the kettle bell 700 is generally similar to the kettle bell 500, 600 as described above. According to a preferred example embodiment, the grasping handle 722 of the grasping ring 720 comprises a rotatable grasping handle component 740 rotatably mounted thereon, for example, which can be configured or adjustable to either permit or prevent rotation thereof relative to the grasping handle 722. As such, in a preventative mode, the rotatable grasping handle component 740 is fixedly mounted to the grasping handle 722, and for example, acts as a normal rigid kettle bell handle. However, in a rotating mode, the rotatable grasping handle component 740 can freely rotate about the grasping handle 722. Accordingly, in the rotating mode, the kettle bell is free to swing about the rotatable grasping handle component 740, and thus, imparts one additional degree of freedom so as to permit additional movement thereof while a user grasps the component 740 to perform one or more exercises (e.g., lifting/moving the kettle bell 700). According to example embodiments, a user can easily manipulate the component 740 between the preventative and rotating modes.

According to one example embodiment, the grasping ring 720 comprises an internal skeletal support structure 750 (see dashed lines), for example, which is covered with one or more desired materials so as to impart a desired feel, flexibility, resiliency, stiffness, etc. thereto. For example, according to one example embodiment, the grasping ring 720 comprises a skeletal support structure 750 and an over-molded or co-molded layer surrounding at least a portion of the skeletal support structure 750. According to example embodiments, the skeletal support structure 750 can be formed from a desired material, for example, metals, natural materials, polymers, plastics, composites, unnatural materials, synthetic materials and/or combinations thereof. According to one example embodiment, a metal comprising a low to medium modulus of elasticity can be used as the skeletal support structure 750, for example, such that at least some deformation of the handle is permitted (e.g., as similarly described above). According to another example embodiment, one or more resilient and flexible (yet structurally sound) metal cables or other components can be incorporated with the grasping ring 720 as desired. In yet another example embodiment, the skeletal support structure 750 can be substantially rigid such that the grasping ring 720 retains its shape and imparts minimal (if any) deformation during use.

According to one example embodiment, the ends of the extension ends 724 comprise an engagement feature 726 for providing engagement with an engagement feature 718 that is formed within the receivers 716 of the mass 712. Thus, according to example embodiments, the grasping ring 720 is manufactured separately from the mass 712, and an assembly step is provided whereby the extension ends 724 are fitted with the receivers 716 such that interengagement is provided between the engagement features 726, 718, thereby connecting the grasping ring 720 to the mass 712. As depicted, the engagement features 726 of the extension ends 724 are shaped to permit one-way engagement (e.g., see angled surfaces), and thus, the overhang portions of the angled surfaces engage with the engagement features 718 of the receivers 716 to prevent disengagement.

Referring to the skeletal support structure 750, according to one embodiment the structure 750 comprises lower extension portions 752, base portions 753, intermediate collar portions 754, and an upper connector portion 756. In example embodiments, the base portions 753 are configured to be substantially secured with the over-molded or co-molded material, for example, such that the skeletal support structure 750 (and lower extension portions 752 thereof) would be prevented from separating from the over-molded or co-molded material (or from the engagement features 718, 726 or receivers 716) during use. According to one example embodiment, the skeletal support structure 750 comprises one or more linked components (e.g., a chain of components), for example, which are connected together but still permit at least some relative movement therebetween. As such, if it is the case that the skeletal support structure 750 does permit at least some relative movement therebetween, the co-molded or over-molded material can be chosen so as to provide a desired amount of flexibility and deformation to the entirety (or at least one or more portions) of the grasping ring 720. According to example embodiments, the co-molded or over-molded material can comprise a desired modulus of elasticity, for example, a low modulus (e.g., substantially flexible/deformable), a medium modulus (e.g., at least partially flexible) or a high modulus (e.g., stiff).

Figure 17:
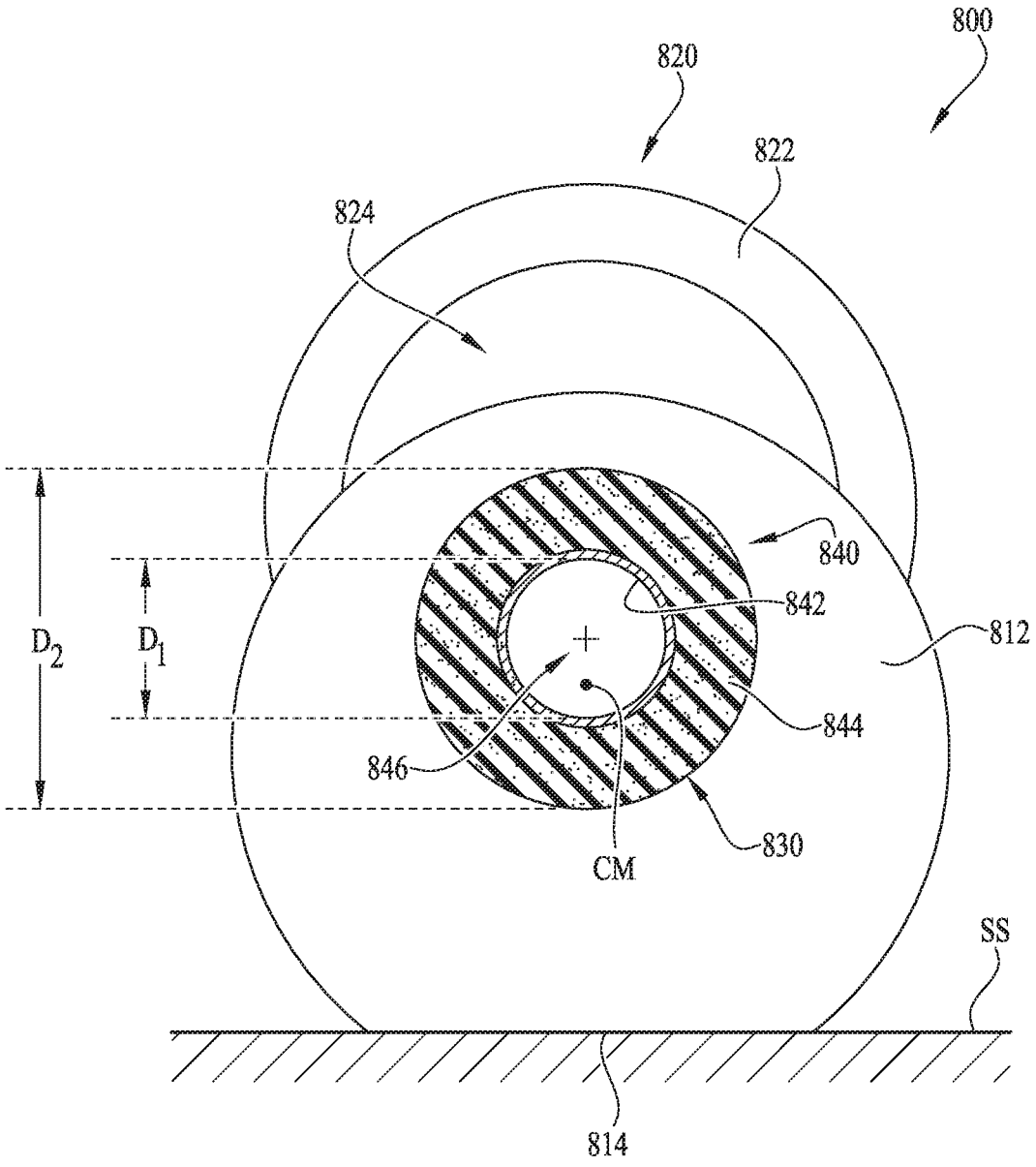
FIG. 17 shows a front plan view of a kettle bell according to yet another example embodiment of the present invention.

FIG. 17 shows a kettle bell 800 according to another example embodiment of the present invention. In example embodiments, the kettle bell 800 is generally similar to the kettle bell 10 as described above. According to example embodiments, the kettle bell 800 comprises a weighted mass or object 812, with a generally flat bottom 814 for resting atop a support surface SS, and a handle 820 extending from an upper portion of the mass 812 to form a grasping ring 822. In example embodiments, the weighted mass or object 812 can be shaped as desired, for example, spherical, cylindrical, or for example, can take on any shape or desired form. According to one example embodiment, the weighted mass 812 is shaped to form a bust-like head of an animal, person or other ornamental shape or configuration.

In example embodiments, an opening 824 is defined between the ring 822 and the upper portion of the mass 812. In preferred example embodiments, an opening 830 (comprising a diameter D2) extends entirely through a generally central area of the mass 812, for example, to provide for accommodating an insert component 840. In example embodiments, the insert component 840 is removably mountable to at least a portion of the mass (e.g., within the opening 830 according to one example embodiment), and for example, comprises a central collar or receiver 842 (comprising an opening 846 and defining a diameter D1) for receiving the collar end CE of a barbell or other exercise device or equipment. According to example embodiments, the diameter D1 is about 2 inches, or for example, at least large enough for permitting engagement with the collar end CE of a barbell (or other exercise equipment). In example embodiment, the diameter D2 can be chosen as desired, for example, being at least partially larger than the diameter D1. For example, according to one example embodiment, the diameter D1 is about 2 inches and the diameter D2 is between about 2.1 inches to about 6 inches, for example, between about 2.1 inches to about 5 inches, for example, between about 2.1 inches to about 4 inches. Optionally, the diameters D1, D2 can be chosen as desired.

In some example embodiments, the insert component further comprises an outer medium 844 that surrounds the receiver 842 and is fitted within the opening 830. According to one example embodiment, the outer medium 844 comprises a material that is at least partially deformable, flexible and/or resilient. According to one example embodiment, the outer medium 844 comprises foam. According to one example embodiment, the foam is open-cell foam. According to another example embodiment, the foam comprises closed-cell phone. In other example embodiment, the medium comprises rubber, an air-filled bladder, natural materials, synthetic materials, and/or other materials and/or combinations thereof as desired. Preferably, according to example embodiments, the outer medium 844 can be chosen so as to provide for at least some displacement thereto. According to one example embodiment, the outer medium 844 is deformable such that the receiver 842 is at least partially displaced while remaining within the opening 830. Thus, according to example embodiments, when the collar end CE of a barbell, exercise equipment or component is fitted with the receiver 842, movement of the collar end CE (and kettle bell 800 connected thereto) can cause deformation of the outer medium 844 and thus permit at least some displacement of the receiver 842 relative to the opening 830.

Accordingly, the insert component preferably provides for at least some dynamic movement of the kettle bell 800 relative to the collar end (or other exercise equipment) during movement of the same, for example, such as movement during an exercise, lift or other activity. As similarly described above, the opening 830 (and receiver 842) are generally offset from the center-of-mass CM of the kettle bell 800, and thus, permits rotation of the kettle bell 800 with respect to the collar end. According to example embodiments, the kettle bell 800 is configured to challenge a user during use, for example, when removably attached to the collar end of an exercise device, for example, such that additional degrees of stability are required (e.g., receiver being offset and deformable insert).

According to some example embodiments, the deformable insert 840 can be formed to provide a desired amount of flexibility (deformation), for example, so as to increase or decrease the movement of the receiver during use. According to some example embodiments, for example, when the kettle bell 800 is used for manual lifting, the insert 840 can be removed therefrom, or for example, a weighted insert can be provided, for example, so as to provide adjustability to the weight of the kettle bell 800. According to another example embodiment, the insert 840 can comprise at least one moveable weight contained therein, for example, such that movement of the kettle bell 800 (lifting/swinging) causes the weight of the insert 840 to move therein, and thus, additional stability is required by the user during an exercise.

While the invention has been described with reference to preferred and example embodiments, it will be understood by those skilled in the art that a variety of modifications, additions and deletions are within the scope of the invention, as defined by the following claims.

What is claimed is:

1. A kettle bell comprising a generally spherical shaped weighted mass, a handle extending from an upper portion of the mass to form a grasping ring, the handle being at least partially resiliently deformable relative to the weighted mass and being formed from a flexible or resiliently flexible material such that at least some amount of deformation of the handle occurs during the application of one or more forces being applied thereto during the use thereof, and one or more stiffening components configured for removable attachment to the handle to provide additional rigidity to the handle as compared to the rigidity of the handle with the stiffening components removed from attachment with the handle.

2. The kettle bell of claim 1, further comprising at least one receiver opening configured for attachment of the kettle bell to a collar end of a barbell.

3. The kettle bell of claim 2, wherein the at least one receiver opening is at least partially formed in the grasping ring.

4. The kettle bell of claim 1, wherein the weighted mass comprises a generally flat bottom for resting atop a support surface.

5. The kettle bell of claim 1, wherein at least the spherical shaped weighted mass comprises iron.

6. The kettle bell of claim 1, wherein the kettle bell comprises a total weight of between 5-115 pounds.

7. A multi-use exercise device comprising:

a weighted mass;

a grasping ring connected to the weighted mass and being at least partially flexible and resiliently displaceable relative to itself and the weighted mass it's connected to, the grasping ring further being adjustable between at least a first configuration and a second configuration, wherein in the first configuration the grasping ring comprises a first stiffness, and wherein in the second configuration the grasping ring comprises a second stiffness, wherein the first stiffness is less than the second stiffness such that the grasping ring in the first configuration comprises greater flexibility than the flexibility of the grasping ring in the second configuration; and at least one stiffening component configured for removable attachment to at least a portion of the grasping ring so as to reduce the allowable deformation of the grasping ring and maintain the same in a second configuration with the least amount of flexibility.

8. The multi-use exercise device of claim 7, wherein the weighted mass comprises a pair of receivers for receiving extension ends of the grasping ring such that the grasping ring is adapted to be permanently or removably attached to the weighted mass.

9. The multi-use exercise device of claim 7, wherein at least the weighted mass comprises iron.

10. The multi-use exercise device of claim 7, wherein the multi-use exercise device comprises a total weight of between 5-115 pounds.

11. The multi-use exercise device of claim 7, wherein the weighted mass comprises a generally flat bottom for resting atop a support surface.

12. A multi-use kettlebell comprising:

a weighted mass; and a resiliently deformable and flexible grasping handle removably attached to the weighted mass, the grasping handle being configured to removably receive one or more stiffening components for reducing the flexibility of the grasping handle.

13. The multi-use kettlebell of claim 12, wherein the grasping handle comprises at least one receiver opening at least partially formed therein.

14. The multi-use kettlebell of claim 13, wherein the one or more stiffening components are configured for removable attachment to the at least one receiver of the grasping handle.

15. The multi-use kettlebell of claim 13, wherein the one or more stiffening components are optionally formed from at least one material selected from a metal, non-metal, composite, plastic, polymer, rubber, synthetic material, natural material and wood.

16. The multi-use kettlebell of claim 15, wherein the one or more stiffening components, are optionally weighted so as to provide adjustability to both the weight and grasping ring flexibility.

* * * * *